137-13

10/6/87 XR 4,697,426

United States Patent [19]

Knowles, Jr.

[11] Patent Number: 4,697,426

[45] Date of Patent: Oct. 6, 1987

[54] CHOKE COOLING WAXY OIL

[75] Inventor: William T. Knowles, Jr., Houston, Tex.

[73] Assignee: Shell Western E&P Inc., Houston, Tex.

[21] Appl. No.: 868,919

[22] Filed: May 29, 1986

[51] Int. Cl.[4] ..... F17C 11/00

[52] U.S. Cl. ..... 62/48; 62/532; 137/13; 166/370; 208/37; 208/370

[58] Field of Search ..... 137/13; 208/37, 370; 166/370; 62/48, 123, 532, 544, 86–88

[56] References Cited

U.S. PATENT DOCUMENTS

| | | | |
|---|---|---|---|
| Re. 25,759 | 4/1965 | Walker et al. | 55/174 |
| Re. 30,281 | 5/1980 | Tackett et al. | 208/37 |
| 2,303,823 | 12/1942 | Coberly | 208/37 |
| 2,352,883 | 7/1944 | Bolley | 62/532 |
| 3,027,319 | 3/1962 | Meyer et al. | 208/370 |
| 3,350,296 | 10/1967 | Torobin | 208/37 |
| 3,429,800 | 2/1969 | Sparks | 62/544 |
| 3,454,464 | 7/1969 | Tuggle et al. | 208/370 |
| 3,773,650 | 11/1973 | Hislop et al. | 208/37 |
| 3,846,279 | 11/1974 | Merrill, Jr. | 137/13 |
| 3,910,299 | 10/1975 | Tacket et al. | 208/37 |
| 3,963,795 | 6/1976 | Wood et al. | 62/532 |
| 4,013,544 | 3/1977 | Merrill, Jr. | 208/37 |
| 4,050,742 | 9/1977 | Hughes et al. | 137/13 |
| 4,141,924 | 2/1979 | Sun | 62/532 |

FOREIGN PATENT DOCUMENTS

| | | |
|---|---|---|
| 768654 | 2/1957 | United Kingdom . |
| 768655 | 2/1957 | United Kingdom . |

*Primary Examiner*—Ronald C. Capossela

[57] ABSTRACT

A stream of gas and waxy oil is cooled by a choke to form a wax/oil slurry, and the slurry is pipeline transported without wax deposition in the pipeline and/or to prevent melting of permafrost along the pipeline right of way.

28 Claims, 1 Drawing Figure

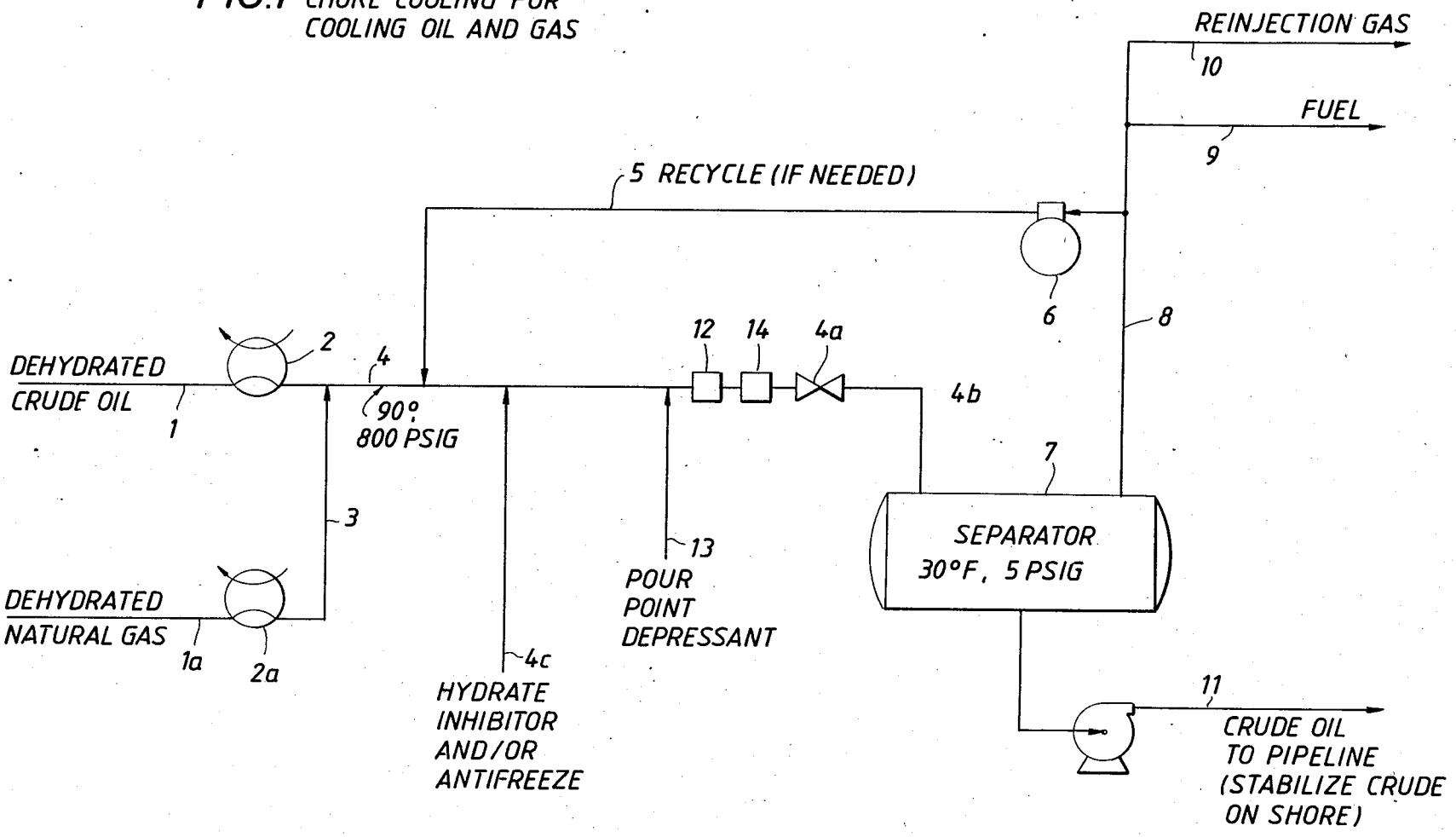
FIG.1 CHOKE COOLING FOR COOLING OIL AND GAS

CHOKE COOLING WAXY OIL

BACKGROUND OF THE INVENTION

The transportation of oils with high cloud points by pipelining can result in the deposition of wax at the pipewall if the oil properties are such that wax precipitates out of solution with the oil at temperatures above the surroundings of the pipeline. In this type of situation, wax will deposit at the pipewall where the oil cools to below its cloud point. One method for prevention of wax deposits in this manner is to pre-cool the oil to, at, or below the coldest wall temperature prior to the oil entering the pipeline. The wax is left in the oil stream. The wax then flows in the pipeline as a slurry with the oil. Thus, as the system is designed, the oil, wax, and pipeline are at essentially the same temperature, the wax will not deposit on the pipe wall. In addition to preventing wax deposits, another benefit of operating a "cold" pipeline, particularly in severely cold environments, is the protection of the frozen soil or permafrost from thawing by a heated, possibly insulated, pipeline. The problem of thaw subsidence due to melting the permafrost is eliminated by operating a pipeline at the same temperature as the frozen soil. The usual method for precooling the oil is with heat exchangers or chillers. However, the problem of wax deposition is then transferred to the heat exchangers or chillers rather than the pipeline.

U.S. Pat. No. 3,454,464 discloses the choke cooling of a petroleum stream in a production well to restrict paraffin deposition. The following U.S. patents are also considered of relevance to the present invention: U.S. Pat. Nos. 3,027,319; 2,303,823; Re. 30,281; Re. 25,759. Also considered of relevance are British Pat. Nos. 768,655 and 768,654.

Commonly assigned application Ser. No. 868,920, filed May 29, 1986 is relevant to the present application.

BRIEF DESCRIPTION OF THE DRAWING

The FIGURE is a schematic view of the invention.

SUMMARY OF THE INVENTION

The present invention pertains to a process for pipelining a waxy oil to essentially eliminate deposition of wax on the pipeline wall. This is accomplished by effecting a sudden pressure drop of the oil to chill the oil, thereby forming a slurry of wax particles and oil. In a preferred embodiment the pressure on an oil and gas stream is suddenly dropped to chill the mixture and form a slurry of wax particles and oil and finally, the slurry is transported through a pipeline. Most preferably, the sudden pressure drop is effected by passing the mixture of oil and gas through a choke.

Other purposes, advantages and features of the invention will be apparent to one skilled in the art upon review of the following.

DESCRIPTION OF PREFERRED EMBODIMENTS

The present invention pertains to the transmission of petroleum oils through pipes or other conduits, and more particularly to the trnasmission of petroleum oils containing waxes. "Crude" or "crude oil" as used herein denotes petroleum oil as produced from the ground or any fluid derived from such oil. "Wax" as used herein denotes any substance, for example paraffin or the like, which starts to crystalize or solidify at a critical temperature, hereinafter called the "cloud point" or "crystalization point". Many petroleum oils contains paraffins, asphaltenes and the like, which have a relatively low temperature of crystalization or cloud point. When a petroleum oil containing wax is passed through a pipe or conduit the inner wall of which is at a temperature below the cloud point of the wax, the wax tends to deposit on such walls in sufficient amounts to materially reduce the free area inside the conduit through which the oil must pass, thus retarding the flow of the oil. Accordingly, a primary purpose of the present invention is to prevent such deposition from petroleum oils which have a considerable wax content. Waxy crude oils have been observed in the 0° to 140° F. range. Cloud points outside of this range are possible. The cloud point of any such oil can be readily determined by one skilled in the art by cooling a film of oil and watching for wax crystals with a microscope or centrifuging a cooling oil and noting the temperature at which wax crystals are thrown out of the oil or by noting the temperature at which wax begins to deposit as a surface exposed to the oil is cooled.

The present invention provides a novel method for cooling oil quickly to below its cloud point without any wax deposition. The oil and natural gas stream preferably is cooled by conventional means to slightly above the cloud point. The oil and gas are then cooled to below the cloud point with an isenthalpic pressure drop through a choke. The wax comes out of solution as the oil is cooled. The wax does not deposit in the choke or downstream of the choke as the wax precipitates in the bulk stream and not at the wall.

The FIGURE illustrates application of the technique of this invention. Oil stream 1, and gas stream 1*a*, represent the components of the full wellhead stream. They may be separated ahead of this process for measurement, dehydration, cooling, or other reason. If necessary, the wellhead stream, whether separated or not, is cooled in a cooler (2 and 2*a*) by conventional means such as a heat exchanger, to a temperature preferably slightly above the cloud point of the oil. Thus, stream 4 represents the full wellhead stream less any water removed and at a temperature preferably slightly above the oil cloud point. If necessary, stream 4*c* containing methanol or the like may be used to dehydrate stream 4. This two phase stream of gas and oil is then expanded through a choke 4*a* to achieve the necessary cooling. The choke can utilize a variable orifice so that the choke can be used as an integral part of the process control strategy. For example, the choke can control the temperature in the separator 7 and provide back pressure on the upstream facilities. By way of example, a crude oil and gas stream of a certain gas/oil ratio and composition at 90° F. and 800 psi will cool to 30° F. when expanded to atmospheric pressure.

If stream 4 does not have a sufficient gas/oil ratio, some gas may be recycled via line 5 and gas compressor 6 to be combined with the stream 4. Stream 4*b* is passed to separator 7. Gaseous stream 8 may be utilized for fuel 9, recycled via line 5, reinjected via line 10, or flared or sold. Oil stream 11 containing wax formed in the choke is pumped into a pipeline for further transportation.

The above pressure and temperature drop example is only illustrative. For a specific design, a process optimization will be required. Variables to be considered include: (1) desired temperature drop, (2) composition of the oil and gas, (3) gas/oil ratio through the choke, (5)

separator pressure, (6) amount of light ends left in the crude, (7) compressor horsepower, (8) pump horsepower, and (9) cost of energy.

The concept of the present invention is not limited to severely cold areas such as the Arctic. For example, cooling to approximately 65° F. will eliminate wax deposition of Gulf of Mexico crudes and cooling to approximately 40° F. will do the same for pipelines in Michigan. In general terms, the range of potential crude oils covered includes all crude oils with cloud points above the minimum wall temperature and pour points not more than 5° to 10° F. above minimum wall temperature.

The use of the choke for precooling the crude oil eliminates wax deposition in the cooling process. Wax deposits on the wall of a heat exchange, pipeline, etc., only if the oil is cooled below its cloud point at the wall. If the oil is cooled in the bulk stream, the wax precipitates out of the oil and remains in the oil stream. It does not stick to the wall unless it precipitates at the wall. Choke cooling provides a sudden chilling of the oil stream. The wax precipitates out of the oil in very small particles and is carried in the oil stream as a slurry. However, some of the oil will be in contact with metal as it is chilled and some small amount of wax may deposit just downstream of the choke. The high velocities, i.e., critical or choking velocities, associated with the choke, however, erode away the wax deposition after an equilibrium buildup of wax is achieved.

In a preferred embodiment a standard static mixer 12 is installed immediately upstream of the choke to provide good mixture of oil and gas. This mixing, along with turbulent flow from a high flow rate, for example 25 feet per second, upstream of the choke, provides a uniform dispersion, small oil drop size and thereby stable choke performance.

The wax crystals formed just downstream of the choke are very small. From a viscosity point of view, larger crystals are preferred and additives such as pour point depressants may be added to modify the wax crystal size via line 13.

Separator 7 is designed to handle a wide variety of wax/oil slurries. Various options include a cone bottom tank, tank stirrers, external circulation pumps and oil jets (not shown). The separator may also include provisions such as swirl tubes (not shown) and demisters (not shown) to separate the oil droplets from the gas. To avoid the problem of gas bubbles being entrapped in or attached to the wax particles causing them to tend to float on the oil, a distributed discharge header (not shown) at the gas/oil interface may be used with an external degassing boot (not shown). All facilities downstream of the choke that are exposed to atmospheric termperature are preferably insulated to prevent the wall temperature from dropping below the oil temperature. Facilities upstream of the choke are also preferably insulated where the wall temperature can drop to the cloud point of the oil. The use of insulation minimizes wax deposition on the walls of the facility.

A thermal break 14 is preferably included between the choke and the upstream piping, for example, an insulating gasket between the choke and upstream piping. This break and the high velocity in the static mixer above, minimizes cooling of the upstream piping and eliminates any wax deposition in the upstream piping.

The water content of the oil and gas is critical in a cooling process. If the temperature downstream of the choke is above 32° F., hydrate formation is controlled by dehydration of the oil and gas upstream of the choke and/or injection of a dehydration agent such as methanol via line 4c. If the temperature downstream of the choke is 32° F. or below, ice formation also occurs. As with the wax, water freezes going through the choke and very small particles of ice will be slurried with the crude oil.

The crude oil taken out of the separator may not meet pipeline vapor pressure specifications. Accordingly, options include stripping the curde with an inert gas, stabilizing the crude at the end of the cold pipeline and using a stabilizer overhead for fuel, and pipelining both gas and oil to the end of the cold line, and separating and stabilizing the crude.

The foregoing description of the invention is merely intended to be explanatory thereof. Various changes in the details of the described apparatus may be made within the scope of the appended claims without departing from the spirit of the invention.

What is claimed is:

1. A process for pipelining a waxy oil having a gas dissolved therein to essentially eliminate deposition of wax on the pipeline wall, comprising:

forming a pressurized mixture of said waxy oil with a gas dissolved therein and an additional gas;

effecting a sudden pressure drop of said mixture of the waxy oil and the gas, thereby expanding a substantial portion of the gas to chill the oil and forming a slurry of wax particles and oil; and pipelining the slurry.

2. The process of claim 1 including mixing the oil with the gas.

3. The process of claim 1 wherein the sudden pressure drop is effected by passing the mixture of oil and gas through a choke.

4. The process of claim 1 wherein the oil and/or gas are partially dehydrated prior to mixing.

5. The process of claim 1 wherein at least part of the gas is removed after forming the slurry.

6. The process of claim 5 wherein at least part of the removed gas is recycled to be mixed with the oil.

7. The process of claim 5 wherein at least part of the removed gas is reinjected into a formation from which the oil is produced.

8. The process of claim 5 wherein at least part of the removed gas is used as fuel at the site of the slurry-forming operation.

9. The process of claim 1 wherein methanol is added to the oil-gas mixture prior to effecting the sudden pressure drop.

10. The process of claim 1 wherein hydrate inhibitor is added to the oil/gas mixture prior to effecting the sudden pressure drop.

11. The process of claim 1 wherein antifreeze is added to the oil/gas mixture prior to effecting the sudden pressure drop.

12. The process of claim 1 wherein the slurry is pipelined through permafrost.

13. The process of claim 1 wherein a static mixer and high velocity in the piping upstream of the pressure drop location are included for the purpose of ensuring stable operations.

14. The process of claim 1 wherein a thermal break is installed between the pressure drop location and upstream piping to prevent heat transfer between the pressure drop location and the upstream piping.

15. The process of claim 1 wherein facilities upstream and downstream of the pressure drop location are insulated.

16. The process of claim 1 wherein some light ends remain in the oil after cooling and are transported with the oil to a pipeline destination and used as fuel for stabilizing the oil.

17. The process of claim 1 wherein after chilling and prior to entering the pipeline, the oil is stripped with an inert gas to remove light ends.

18. The process of claim 1 wherein after chilling, the oil and some of the gas are transported as a two-phase fluid to a pipeline destination.

19. The process of claim 1 wherein after chilling, the oil, wax and some of the gas are transported as a three-phase fluid to a pipeline destination.

20. The process of claim 1 wherein upstream of the pressure drop location, the oil and gas are cooled by conventional means to a temperature above the cloud point of the oil.

21. The process of claim 1 wherein ice particles formed in the chilling step are slurried with the oil.

22. The process of claim 1 wherein the pressure drop step is used as an integral part of process control strategy.

23. The process of claim 1 wherein addition of pour point depressant is used for modifying wax crystal size.

24. A process for providing a process for pipelining a waxy oil to essentially eliminate deposition of wax on the pipeline wall, comprising:

providing a pressurized mixture of said waxy oil and a gas;

effecting a sudden pressure drop of said mixture of the waxy oil and the gas, thereby expanding a substantial portion of the gas to chill the oil and forming a slurry of wax particles and said waxy oil;

pipelining the slurry; and removing at least part of the gas from the slurry and recycling said at least part of the removed gas to be mixed with the waxy oil to form said mixture of the waxy oil and the gas.

25. A process for pipelining a waxy oil to essentially eliminate deposition of wax on the pipeline wall, comprising:

providing a pressurized mixture of said waxy oil and a gas;

effecting a sudden pressure drop of said mixture of the waxy oil and the gas, thereby expanding a substantial portion of the gas to chill the oil and forming a slurry of wax particles and said waxy oil;

pipelining the slurry; and removing at least part of the gas from the slurry and reinjecting at least a part of the removed gas into a formation from which the waxy oil is produced.

26. A process for pipelining a waxy oil to essentially eliminate deposition of wax on the pipeline wall, comprising:

providing a pressurized mixture of said waxy oil and a gas;

adding a hydrate inhibitor to said mixture of the waxy oil and the gas;

effecting a sudden pressure drop of the mixture of the waxy oil and the gas, thereby expanding a substantial portion of the gas to chill the oil and form a slurry of wax particles and oil; and pipelining the slurry.

27. A process for pipelining a waxy oil to essentially eliminate deposition of wax on the pipeline wall, comprising:

providing a pressurized mixture of said waxy oil and a gas;

cooling the mixture of the waxy oil and the gas by heat exchange to a temperature just above the cloud point of the oil;

adding a hydrate inhibitor to the mixture of the waxy oil and the gas;

effecting a sudden pressure drop of the mixture of the waxy oil and the gas, thereby expanding a substantial portion of the gas to chill the oil and form a slurry of wax particles and oil; and pipelining the slurry.

28. A process for pipelining a waxy oil to essentially eliminate deposition of wax on the pipeline wall, comprising:

providing a mixture of said waxy oil and a gas;

adding a pour point depressant to the mixture of the waxy oil and the gas;

effecting a sudden pressure drop of the mixture of the waxy oil and the gas, thereby expanding a substantial portion of the gas to chill the oil and form a slurry of wax particles and oil; and pipelining the slurry.

* * * * *